US005718572A

United States Patent [19]

Hitzel

[11] Patent Number: 5,718,572

[45] Date of Patent: Feb. 17, 1998

[54] NOVELTY CANDLE SUPPORT BASE

[75] Inventor: Debra Hitzel, College Point, N.Y.

[73] Assignee: Easter Unlimited, Inc., Carle Place, N.Y.

[21] Appl. No.: 740,994

[22] Filed: Nov. 5, 1996

[51] Int. Cl.[6] ..... F23D 3/16

[52] U.S. Cl. ..... 431/292; 431/288; 431/125

[58] Field of Search ..... 431/292, 119, 431/125, 126, 288, 289, 294

[56] References Cited

U.S. PATENT DOCUMENTS

| | | | |
|---|---|---|---|
| 183,573 | 10/1876 | Kahlke | 431/294 |
| 737,966 | 9/1903 | Rummelin | 431/294 |
| 2,202,064 | 5/1940 | Olsen | 431/292 X |
| 2,681,555 | 6/1954 | Babbitt | 431/294 |
| 3,556,704 | 1/1971 | Grasznick | 431/290 |
| 3,730,674 | 5/1973 | Gross | 431/288 |
| 3,826,606 | 7/1974 | Hicks | 431/288 X |
| 4,544,351 | 10/1985 | Marsicano | 431/288 |
| 5,069,617 | 12/1991 | Lin | 431/253 |
| 5,078,945 | 1/1992 | Byron | 431/294 X |

*Primary Examiner*—Larry Jones

*Attorney, Agent, or Firm*—Lackenbach Siegel Marzullo Aronson & Greenspan

[57] ABSTRACT

A candle-related novelty item includes a candle support base which is generally upright and has a plurality of openings formed in a surface sculpture formed on the base. A channel provided with an inlet opening at the top of the base in fluid flow communication with each of the openings, the inlet opening being arranged proximate to a candle receiving cup for receiving a candle. The candle is so arranged and so constructed that the burning candle causes molten wax to flow into the inlet opening of the channel to flow through and harden about the openings by being guided to those openings by the channel formations within the base, resulting in the build up of wax within the channels.

24 Claims, 5 Drawing Sheets

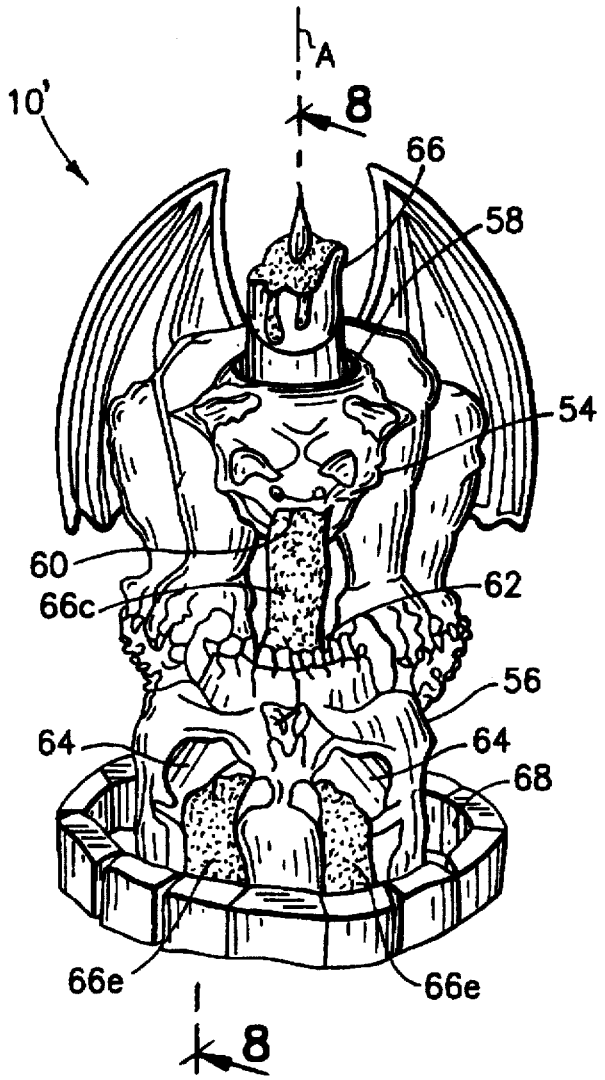
FIG. 7
FIG. 8
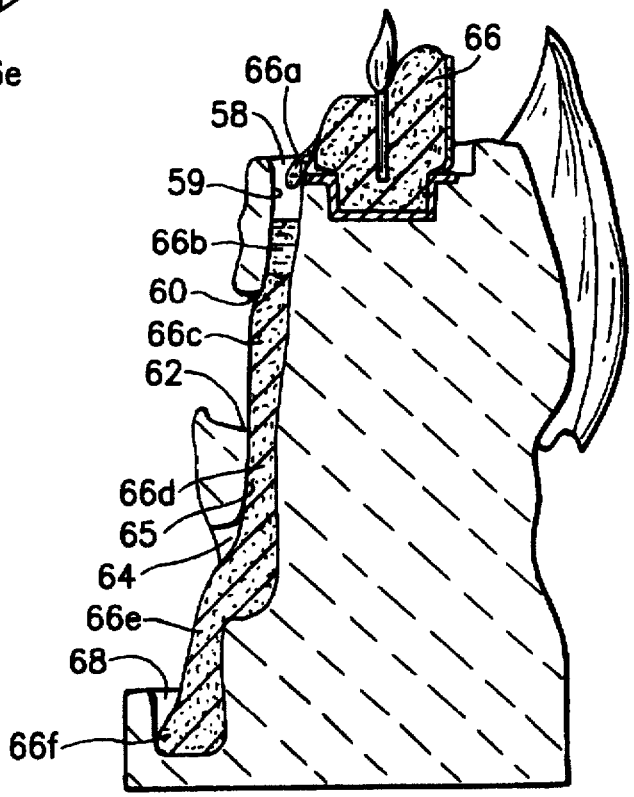

FIG. 9
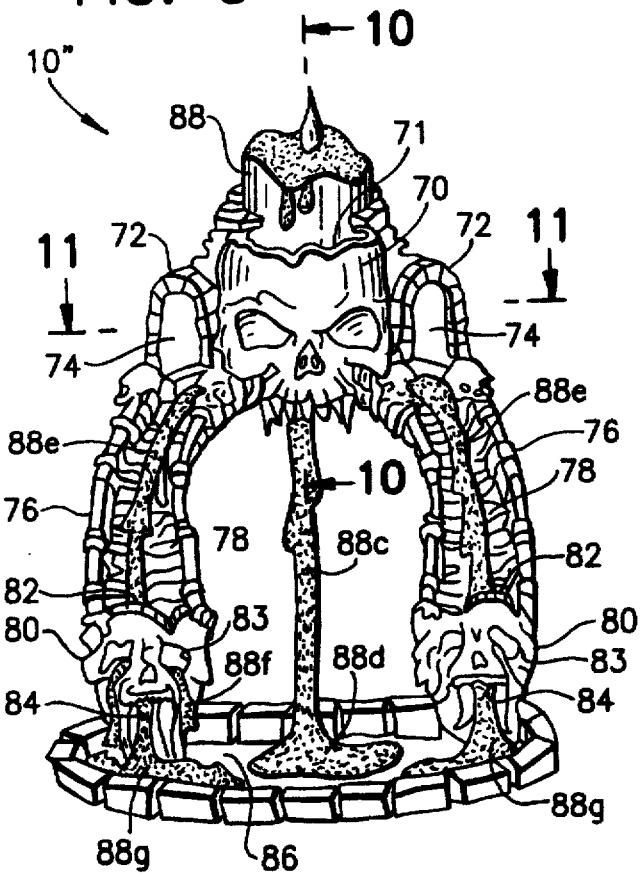
FIG. 10
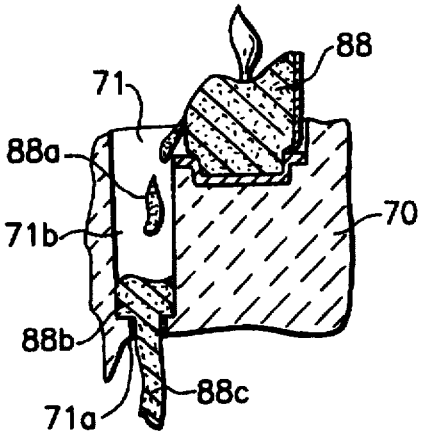
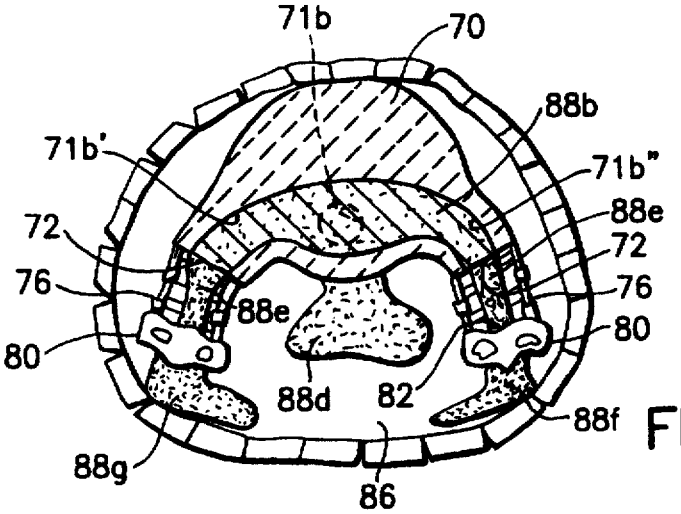
FIG. 11

NOVELTY CANDLE SUPPORT BASE

BACKGROUND OF THE INVENTION

1. Field of the Invention

This invention generally relates to candle-related novelties and, more specifically, to a candle and sculptured candle support base which channels the molten wax from the burning candle through one or more openings in the sculptured base where the wax is discharged through the opening (s) and hardens to provide interesting and dramatic effects by modifying the external features of the sculptured base.

2. Description of the Prior Art

While numerous candle holders have been created which include regions for capturing molten wax, such wax receiving regions have primarily served as a safety feature and not for the purpose of modifying the exterior surface or shape of the candle holder. See, for example, U.S. Pat. No. 3,556,704 issued to Jrasznick; and U.S. Pat. No. 5,069,617 issued to Lin.

In U.S. Pat. No. 4,681,534 issued to Schenke et al., a candle holder is disclosed with draining holes. However, while the base is provided with drain holes, these are used for a very specific purpose. Once a candle is consumed and removed from the holder, hot water or other wax dissolving liquid is introduced into the candle holder and the drain holes serve the function of allowing the liquid and the remaining wax to be dissolved and flushed out so as to clean the interior of the candle holder. However, there is no wax receiving cavity which is in fluid flow communication with the drain holes, and the burning of the candle and the resulting molten wax is not directed or funneled through these drain holes.

SUMMARY OF THE INVENTION

Accordingly, it is an object of the present invention to provide a candle-related novelty item which is different from known candle novelty items and provides new and different results or effects.

It is another object of the present invention to provide a candle-related novelty item which is simple in construction and inexpensive to manufacture.

It is still another object of the present invention to provide a candle-related novelty item as suggested in which the sculptured surface features of candle support base can be selected to correspond to the seasonal holidays during which the candle is used.

It is yet another object of the present invention to provide a candle-related novelty item as suggested in the previous objects which is particularly suitable for use during Halloween, in which case the base may be sculptured to be in the shape, for example, of a skull, and the molten wax channelled through openings which simulate the mouth and eye cavities in the skull.

It is a further object of the present invention to provide a candle-related support base as in the previous objects which ensures adequate flow of molten wax through channels in a support base for discharge through lateral or side openings in the base to provide the desired effect.

It is still a further object of the present invention to provide to candle-related novelty item, as in the previous objects, in which required or desired flow of wax is assured by utilizing a candle having an offset wick which is offset in the direction of the wax receiving channels.

It is yet a further object of the present invention to provide a candle-related novelty item in accordance with the previous objects which is provided with a safety molten wax receiving channel or trough which captures excess molten wax discharged through the lateral openings in the base to enhance the safety in the use of the time.

It is an additional object of the invention to provide a candle-related novelty item as in the previous objects, in which the candle may be covered with a suitable coating having a finish or color different than the color of the wax forming the candle so that the color of the molten wax which is discharged through the openings in the base is different than the external appearance of the candle.

In order to achieve the above objects, as well as others which will become apparent hereinafter, a candle support base in accordance with the present invention comprises a generally upright body having the lower end configurated to allow the base to be supported and an upper end which includes candle receiving means for receiving the lower end of a candle. At least one opening is provided in said body intermediate said upper and lower ends. Conduit means is provided having inlet and outlet ends, said inlet end being arranged proximate to said candle receiving means for receiving molten wax which drips off the burning candle supported in said receiving means. Said outlet end is in fluid flow communication with said at least one opening in said body. In this manner, the burning candle causes at least some of the molten wax to flow through said conduit means and be discharged through and solidify in the region of said at least one opening in said base.

The invention also preferably contemplates the use of a candle which is provided with an eccentric or offset wick to cause one side of the candle to melt more quickly than any other side to assure that the majority of the molten wax flows down the candle and into said inlet end of said conduit means when the candle is suitably oriented in said candle receiving means. However, such candle with offset or eccentric wick is preferably used with a base in which the upright body of the base defines a generally vertical axis when the base is placed on a horizontal support surface. A standard or conventional candle with a centrally arranged wick may be used when the axis of the body of the base generally which is offset from the vertical in the direction of said conduit means inlet end to assure that the majority of the molten wax likewise flows into said inlet end of said conduit means.

While a single opening may be provided in said body, in which case said conduit means comprises a single channel extending between said candle receiving means and said one opening, a plurality of openings may be provided along the axial or longitudinal length direction of said upright base, in which case a plurality of channels are provided each extending from said candle receiving means and an associated opening or a single channel may be used which is in fluid flow communication with all of the openings.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of preferred embodiments in which:

FIG. 7 is another embodiment of a sculptured candle base in accordance with the invention, after wax from a burning candle flows unto it and through primary and secondary channels;

FIG. 8 is a cross-sectional view of the sculptured base shown in FIG. 7, taken along line 8—8;

FIG. 9 is a front elevational view of still another embodiment of a sculptured candle base in accordance with the invention, after wax from a burning candle flows unto to it and through a plurality channels arranged in parallel to each other to allow wax to flow substantially simultaneously through the channels;

FIG. 10 is a cross-sectional view of the sculptured base shown in FIG. 9, taken along line 10—10; and FIG. 11 is a cross-sectional view of the sculptured base shown in FIG. 9, taken along line 11—11.

DESCRIPTION OF A PREFERRED EMBODIMENT

Figure 1:
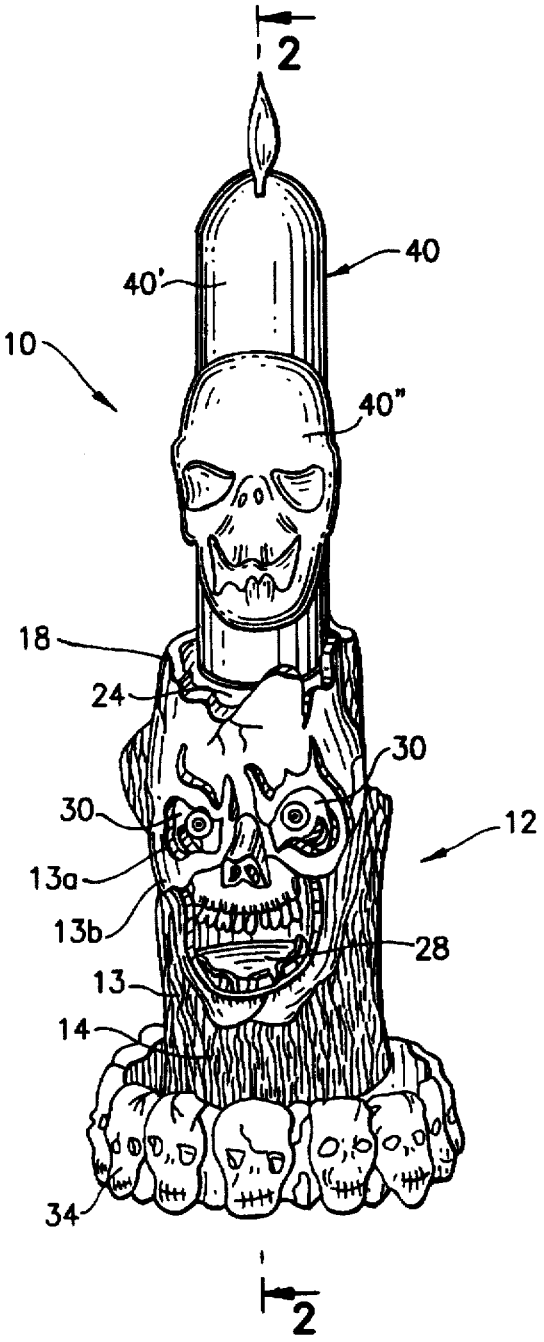
FIG. 1 is a frontal perspective view of a candle-related novelty item, showing a candle base and candle in accordance with the present invention when the candle is first lit.
Figure 2:
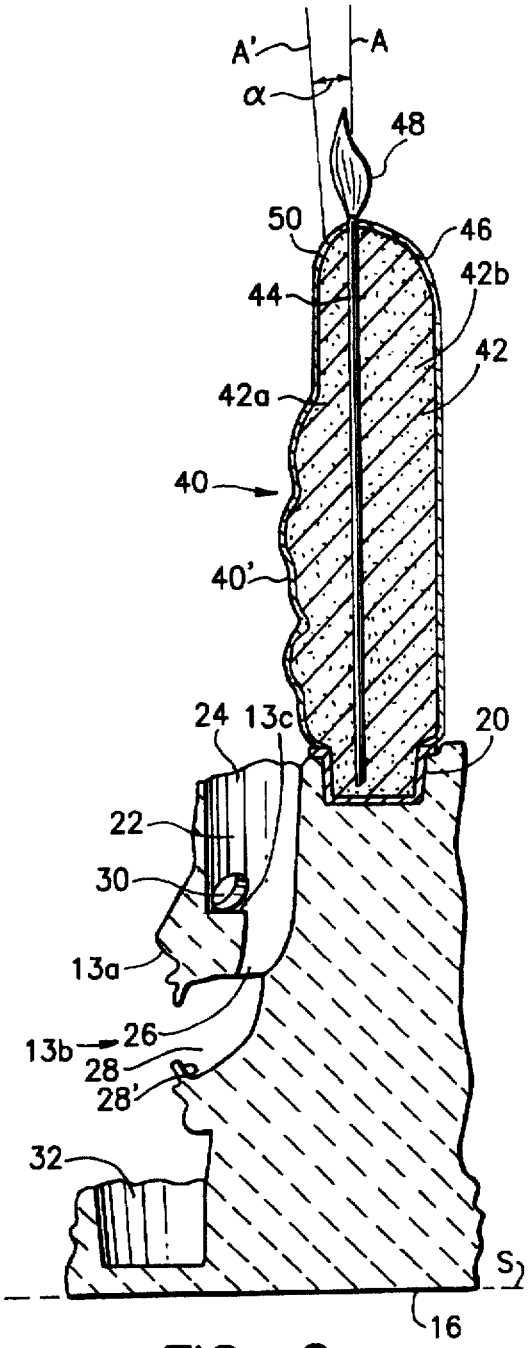
FIG. 2 is a longitudinal cross-sectional view of the base and candle, shown in FIG. 1, taken along line 2—2.

Referring now specifically to the Figures, in which similar or identical parts are designated by the same reference numerals throughout, and first referring to FIGS. 1 and 2, a novelty candle-related item in accordance with the present invention is generally designated by the reference numeral 10.

The novelty item 10 preferably contemplates both a sculptured candle support base 12 and a special candle 40, to be described. However, as will be clear, the present invention also contemplates the use of the support base 12 with a conventional candle. The advantages of using the special candle 40 of the present invention will become evident from the description as follows.

The candle support base 12 includes a generally upright body 13 which generally defines longitudinal axis A and has a lower end 14 which is configurated to allow the base to be supported on an appropriate support structure. As shown, the candle support base 12 is intended to be supported on a generally horizontal surfaces, such as a tabletop, counter, window ledge or the like. For support on such horizontal surfaces, the base is provided at the lower end 14 with a generally flat support surface 16 which is substantially normal to the axis A. Such orientation of the support surface 16 assures that the axis A will be substantially vertical. However, as will also be evident to those skilled in the art, it is also possible to arrange the support surface 16, or otherwise configurate the base lower end, so that when normally supported the axis of the base A' (FIG. 2) will be slightly angularly offset from the vertical direction by an angle α. As will become evident, it is preferable to orient the direction of the candle along the axis A when the candle is specifically made to be used with the base 12, while a conventional candle is preferably arranged from the base 12 along the direction A'. This will be further discussed below.

An important feature is the present invention is the provision of at least one opening in the body 13 which is intermediate the lower and upper ends 14, 18. The body 13 of the base 12 is provided at the upper end 18 with candle receiving means dimensioned and configurated for receiving the lower end of a candle, as best shown in FIG. 2. The candle receiving cup 20 is preferably made of a metallic or other non-flammable material.

Another important feature of the present invention is the provision of conduit means, in the form of a channel or conduit 22, having an upper inlet end 24 and a lower outlet end 26, the inlet end 24 being arranged proximate to the candle receiving cup 20, at the base of any candle that is placed within the cup, to receive molten wax which drips off the burning candle supported in the receiving cup 20. The channel or conduit 22 is in fluid flow communication with openings formed in the body 13 of the base 12. In the embodiment illustrated, the base 12 is provided with a surface sculpture 13*a* is in the form of a human skull facing a predetermined direction which, for purposes of the description, will be defined as the front direction 13*b* of the base 12. While the illustrated embodiment is a novelty candle-related novelty item primarily suited for the holiday of Halloween, it is clear that other surface sculptures may be used to reflect other seasonal themes. For purposes of this application, a sculptured base will be defined as a base that exhibits any external surface features before wax from a burning candle is deposited on it.

The embodiment illustrated in FIGS. 1 and 2, three openings are provided in the body 13 each of which is intermediate the lower and upper ends 14, 18. More specifically, a primary opening 28 is provided in fluid flow communication with the outlet 26 of the channel or conduit 22. Two secondary openings 30 are provided at a point intermediate the primary opening 28 in the inlet end 24 of the channel or conduit 22. Preferably, for reasons to be described, the primary opening 28 is provided with a surface or ledge 28' to ensure that the molten wax does not freely discharge through the primary opening 28 without providing at least some accumulation of molten wax. Similarly, a step or ridge 13*c* is preferably provided just below the secondary openings 30 to accelerate the discharge of molten wax through the secondary openings 30 when the level of wax reaches the ledge 13*c*, as to be described.

Figure 3:
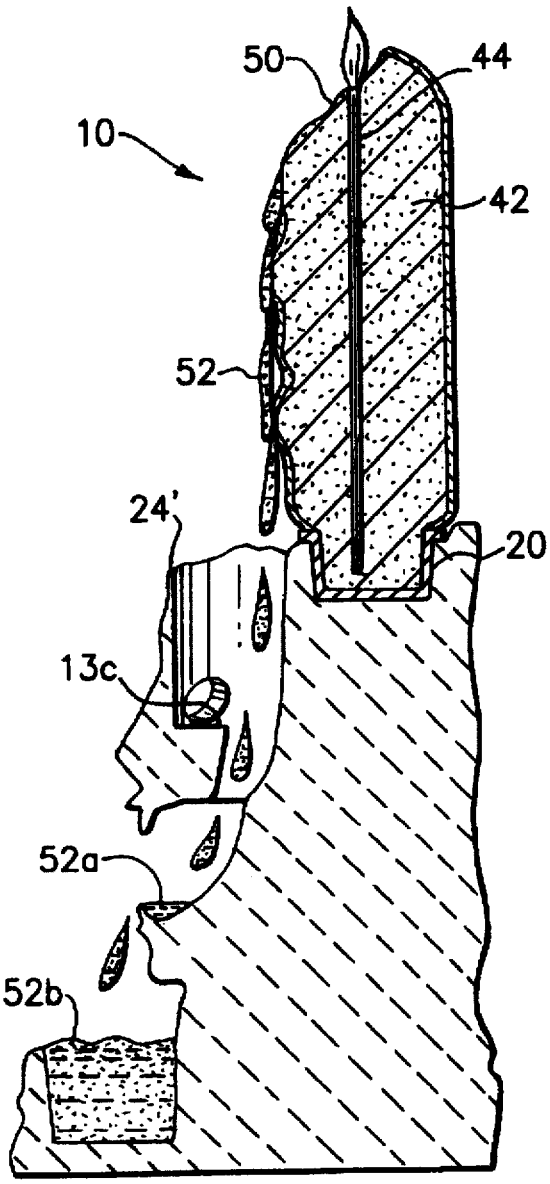
FIG. 3 is similar to FIG. 2, but shows the candle at a point where it has begun to melt and molten wax is shown streaming through a channel within the body of the base and starting to accumulate and solid in the region of a lower opening in the body and into the safety receiving trough.

Advantageously, there is provided a trough or channel 32 below the lower most opening, the primary opening 28 of this embodiment, for receiving excess wax discharged through such opening, as will be more fully described in connection with FIGS. 3–5. Optional decorations, shown in FIG. 1 to be a series of adjacent positioned skulls 34, may be used to decorate the region surrounding the trough or channel 32.

As will become evident, the present invention may be used with a single opening which includes retaining means, such as the ledge or surface 28', below the opening 28 for at least partially intercepting the molten wax which flows down the candle during normal use through the conduit or channel 22 to allow the molten wax to accumulate and solidify at the opening, as will be discussed in connection with FIGS. 3–5. When a single opening is provided on the body 13, only a single channel or conduit may be used which extends between the candle receiving cup 20 and the opening. However, where a plurality of openings are provided in the body, such as the primary opening 28 and the secondary openings 30 in the instant embodiment, the conduit or channel 22 can either consist of a single channel which is in fluid flow communication with each of the openings, as illustrated in FIG. 2, or a plurality of channels may be used, each of which extends from the candle receiving cup 20 and an associated opening. In this manner, molten wax is initially directed to the lower most opening, the primary opening 28 in this case, the wax progressively rising to successively higher openings above the lower most opening, here the secondary openings 30.

In the instant embodiment, the primary and secondary openings 28, 30 blend in with the surface sculpture 13*a*. However, it will be clear that the surface sculpture and the openings in the body 13 are preferably formed to blend in with the motif of the sculpture. Here, the openings coincide with the positions of the eyes and the mouth and the positions coincide with the anatomical positions in the human skull. However, the specific locations of such openings will clearly differ with different surface sculptures, as may be used for different seasonal motifs.

As indicated, the lower end 14 of the body 13 includes a flat surface 16 which can be placed on a flat or generally horizontal support surface S (FIG. 2). However, other support features may be used to suitably position the base 12 on a supporting structure. The specific configuration of the lower end 14 for purposes of mounting the base 12 on a support structure is not critical for purposes of the present invention. However, when the support surface 16 is generally normal or perpendicular to the longitudinal axis A of the base 12, it is clear that the axis A will generally be substantially vertical when the base 12 is placed on a horizontal surface. As is clear from FIG. 2, the placement of a candle 40 within the receiving cup 20 will result in the candle being arranged along a direction generally parallel to the vertical axis A.

The candle 40 that can be used with the novel base 12 may be either a conventional cylindrical candle in which the wick is arranged along the central axis of the candle or may be a candle particularly suited for use with the base 12. Referring to FIG. 2, the special candle 40 that is preferably used in combination with the base 12 is a candle formed of molded wax 42 which is provided with an eccentric or offset wick 44, so that when the candle 40 is appropriately placed or oriented in the receiving cup 20 the wick 44 is shifted towards the front 13*b* of the body 13 relative to the position of the wick of a conventional candle. As will be more fully described in connection with FIGS. 3–5, the eccentric or offset wick causes the candle to melt more quickly on the side of the candle to which the candle is offset to ensure that the majority of the molten wax flows down the front of the candle 40' and into the inlet end 24 of the conduit or channel 22.

Because the object of the present invention is to ensure sufficient flow of molten wax into the conduit or channel 22, the use of a conventional candle may require some angular shifting or tilting of the axis of the candle relative to the vertical, as suggested in FIG. 2. In FIG. 2 an inclined axis A' is shown angularly shifted an angle $\alpha$ from the vertical axis A in the direction of the channel or conduit 22, or the front 13*b* of the body 13, to assure that the majority of the molten wax flows into the inlet end 24. It is clear that such shifting of the axis may be achieved either by inclining the support surface 16 relative to the longitudinal axis A of the body 13 or by slightly rotating the candle receiving cup 20 at the upper end 18. Either approach would be effective in slightly tilting the candle 40 so that the molten wax would flow towards the front 13*b* of the body by the action of gravity. Such molten wax would, then, flow down the front side 40' of the candle 40 and into the inlet end 24. While the present invention contemplates the use of any candle to achieve the desired object, the preferred embodiment utilizes the candle 40 with the offset wick 44 as shown in FIG. 2. By maintaining the candle in a vertical orientational along the axis A, the candle 44 is in its most stable position and avoids any possible dangers or hazards of the candle tipping and becoming dislodged from the candle receiving cup 20.

The manner of operation of the candle novelty item 10 will now be described in connection with FIGS. 2–6. In FIG. 2, the channel or conduit 22 is shown empty as is the trough or channel 32. The wick 44 of the candle 40 has been lit with a flame 48. Although the candle 40 is upright and extends along a vertical direction, the front side 40' of the candle melts at a quicker rate than does the reverse or opposite side, to provide an inclined surface 50 at the upper end of the candle. The melting of the flame 48 causes the wax to melt at the inclined surface 50, thereby causing the molten wax 52 to drip down the front side 40' of the candle and into the inlet opening 24. Depending on the shape of the channel or conduit 22, and any obstacles to the flow of the molten wax therein, the wax 52 will travel down the channel or conduit 22 until it reaches the primary opening 28. The surface or ridge 28' intercepts at least some of the flowing molten wax to provide a first wax accumulation 52*a*. Excess wax is discharged through the primary opening 28 and into the trough or channel 32, where such excess wax 52*b* becomes hardened. The molten wax 52 travels through the channel or conduit 22 due to the action of gravity. Some of the wax accumulation at 52*a* drips from the opening 28 and, as the flow of molten wax decreases through the opening 28 and the build up of wax accumulation 52*a* increases, as suggested in FIG. 4, excessive drippings harden into deposits of solid elongate streams similar to stalactites or icicles.

Figure 4:
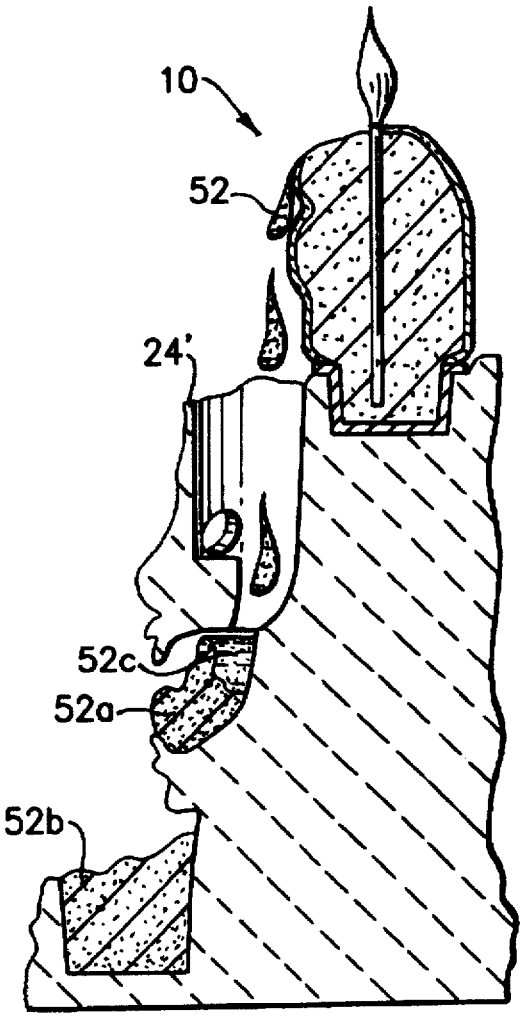
FIG. 4 is similar to FIG. 3, but illustrates the candle at a point of further consumption, in which the lower most opening is substantially filled with solidified wax and the channel feeding the aforementioned opening starting to fill with wax after it can no longer be discharged through the lower most opening.
Figure 5:
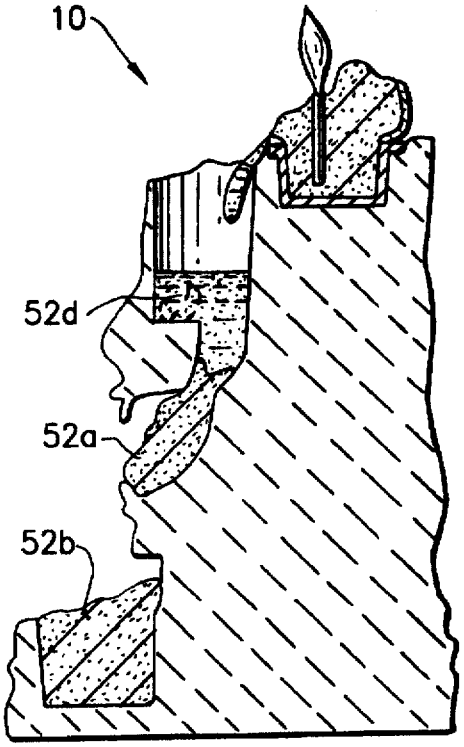
FIG. 5 is similar to FIGS. 3 and 4, in which the candle is shown at a point almost completely consumed, with most of the wax having filled the channel to a level above the height of secondary openings within the base to cause discharge of molten wax through such secondary openings.

Continued burning of the candle, as in FIG. 4, causes molten wax 52 to continue to enter into the channel or conduit 22, further increasing the quantity of molten wax within the channel or conduit, as at 52*c*. In this condition, it is clear that continued wax discharge through the primary opening 28 ceases and the level of wax within the channel or conduit 22 continues to rise. When the wax rises to the level of the secondary openings 30, the molten wax 52 discharges through the secondary openings, as shown in FIG. 6, in which similar stalactites or icicle type wax formations are formed as the wax streams from the secondary openings and harden as they descend.

An optional feature of the present invention is the covering of the candle 40 with a coating 46 which may be of a design or color consistent with a theme of the surface sculpture of the base or which may be simply be decorative. In one presently preferred embodiment, a coating 46 may be, for example, green, while the color of the wax 42 is red. In this manner, it is clear that as the candle 40 melts the molten wax 52 which streams down the channel or conduit 22 will be red in color and will give the appearance or illusion of blood flowing through the primary and secondary openings 28, 30.

As the body 13 of the base 12 is provided with a surface sculpture 13*a* on the front 13*b* of the base, the candle 40 may also be provided with an optional sculpture 40" which forms part of the candle. In the design illustrated in FIG. 1, the optional sculpture 40" is likewise in the form of a human skull.

Figure 6:
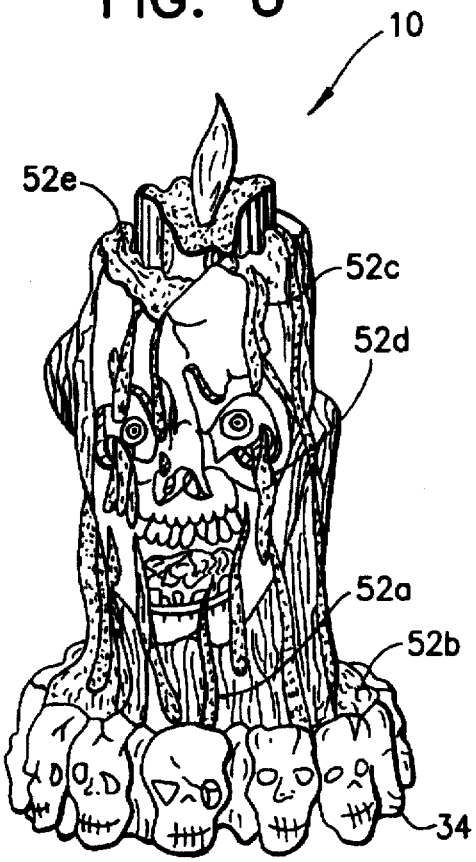
FIG. 6 is a view similar to FIG. 1, but illustrating the wax discharges through the primary and secondary openings in the base when the candle has been substantially totally consumed as shown in FIG. 5.

Once the entire channel or conduit 22 is filled with molten wax, any excessive wax which streams down from the burning candle can flow over the upper edge 24' at the inlet 24 to likewise form additional stactalite or icicle type formation as suggested at 52*e* in FIG. 6. It is clear, therefore, that a very dramatic modified sculpture may be formed by the appropriate selection of the number and positions of the surface sculptures used, the number of openings and the arrangement of channels or conduits connecting the inlets end 24 with such openings.

In the first embodiment 10 of the candle base, vertically displaced openings 28, 30 are arranged along a common channel or conduit 22 in such a way that the wax does not flow through the secondary openings 30 upstream of the channel until sufficient wax has been built up in the primary opening 28 and in the conduit 22 so that the wax buildup reaches the elevation of the secondary opening 30. The flow of wax through the respective openings, therefore, is time wise sequential, there being a delay before wax flows through the secondary openings 30, after it initially flows through the primary openings 28. Other arrangements or combinations of wax flow is, however, possible as will be suggested by the description of FIGS. 7–11 that follows.

In FIGS. 7 and 8, a different candle base sculpture in the shape of a gargoyle is generally designated by the reference numeral 10'. The sculpture 10' includes a first sculptured portion 54 in the form of a head of the gargoyle and a second sculptured portion 56 in the general shape of an inverted skull designated by the reference numeral 56. The sculptured portions 54, 56 are generally arranged along the axis A of the base of the candle, the sculptured portion 56 generally being aligned with the first sculptured portion 54 but being disposed below it as shown. The first sculptured portion or head 54 has a wax inlet 58 and an opening 60 which also serves as a downstream outlet for molten wax. The second sculptured portion or inverted skull 56 has an upper inlet 62 and lower openings 64, as shown. As with the first embodiment, the base 10' includes a trough 68 at the bottom of the base for collecting any excess accumulation of wax. As best shown in FIG. 8, the first inlet 58 and the first outlet 60 are joined by a channel 58 while the second inlet 62 and the second outlet or opening 64 are joined by a channel 65.

Referring primarily to FIG. 8, the operation of the candle base 10' will now be described. A melting candle 66 is provided, configurated or oriented to induce molten wax 66*a* to flow towards the front of the base and into the first inlet 58. Wax 66*b* then flows through the channel 59 in the first sculptured portion or head 54 through the opening 60 which, in the sculpture illustrated, forms the mouth of the head 54. The opening 60 also serves as an outlet through which the flowing wax 66*c* flows down into the second inlet 62 which, in the sculpture illustrated, forms the mouth of the inverted second sculptured portion or skull 56. The flowing wax 66*d* is then released through the secondary openings 64, which in the sculpture form the eye recesses in the inverted skull 66. The wax 66*e*, to the extent that it has not yet hardened, flows into the trough 68 and collects at 66*f*. It is clear, therefore, that with the embodiment 10', there are two channels 59, 65 within the sculpture or body of the base which are arranged in tandem or in series, the wax first flowing through the upper channel 59 and subsequently through the lower channel 65, with one being upstream of the other in relation to the downward flow of the molten wax due to the action of gravity. While the channels 59 and 65 are in series with each other, it is clear that the two secondary openings 64 form parallel paths, so that molten wax, flows separately and simultaneously through each of the channels 64, at 66*e*.

While the sculpture or candle base 10' forms a hybrid arrangement of channels, first sequential or in series, and subsequently parallel, FIGS. 9–11 illustrate an arrangement of channels in which molten wax initially flows in three separate parallel paths, as will now be described.

The sculpture or candle base illustrated in FIGS. 9–11 is generally designated by the reference numeral 10". The base 10" consists of a first sculptured portion 70 which, in the embodiment shown, is in the form of a human skull forming, at the top thereof, an inlet 71 for molten wax, as will be described. Laterally arranged, to each side of the skull 70, are a pair of gates or portals 72 defining outlet openings 74. Each openings 74 opens to a curved elongate support structure 76 which preferably has a U-shaped cross-section to simulate a staircase including steps 78 along the lengths thereof. At the base of each support structure or staircase 76 there is provided a further sculptured portion 80, in the form of a skull, each skull 80 including an inlet 82 at the top thereof and an outlet opening 84 at the region of the mouth of the skull. The skulls or heads are mounted on a suitable base which is provided with a trough 86 for the accumulation of excess wax, as will be described.

The operation of the candle base 10" will now be described. A burning candle 88, positioned at the uppermost end of the base and configurated or oriented as previously suggested to induce molten wax 88*a* to flow into the inlet opening 71, results in molten wax 88*a* to flow through the channel 71*b* within the sculptured portion 70 and flow through the channel 71*b* to opening 71*a* at the bottom of the skull 70. The wax accumulation 88*b* flows through the opening 71*a* and streams downwardly, at 88*c*, to accumulate at 88*d* within the trough 86.

As best illustrated in FIG. 11, the molten wax 88*b* within the skull 70 is provided with multiple parallel paths. Thus, one path is through the opening 71*a* to flow directly downwardly as described. However, additional parallel paths or channels 71*b'* and 71*b"* are provided which lead through the openings 74. The wax that flows through the aforementioned channels flow through the opening 74 within the gates or portals 72 and down each of the respective elongate supports or staircase. The wax 88*e*, to the extent that it is still molten, flows down the steps 78 due to the action of gravity and into the inlet 82 at each of the sculptured heads 80. Each of the lower skulls or heads 80 can be configurated similarly to the sculpture 13*a* of the first embodiment 10, to provide openings 83 at the positions of each of the eyes and lower opening 84, at the position of the mouth. Alternatively, only the openings 83 or the outlet 84 may be provided. Where flow from the openings 83 is provided for, molten wax 88*f* results and wax accumulation at 88*g* results when wax is permitted to flow through the lower outlets 84. Therefore, while flow in the embodiment 10' of FIGS. 7 and 8 is initially in series and subsequently parallel, the flow of wax in the embodiment 10" of FIGS. 9–11 is initially parallel and subsequently in series, although additional parallel flow can be provided for if both openings 83 and 84 are provided as shown. It will be clear, therefore, that many different combinations of channels and surface sculptured features can be provided to provide varied interesting and dramatic effects.

Numerous alterations of the above structures herein discussed will suggest themselves to those skilled in the prior art, however, it is to be understand that the present disclosure relates to preferred embodiments of the invention which are for purposes of illustration only and are not to be construed as limitation of the invention.

I claim:

1. Candle support base comprising a generally upright body having a lower end configurated to allow the base to be supported and an upper end which includes candle receiving means for receiving the lower end of a candle; at least one opening in said body intermediate said upper and lower ends; and conduit means within said upright body having inlet and outlet ends, said inlet end being arranged proximate to said candle receiving means for receiving molten wax which drips off a burning candle supported in said receiving means, and said outlet end being in fluid flow communication with said opening in said body, whereby the burning of the candle causes at least some of molten wax to flow through said conduit means and be discharged through and solidify in the region of said at least one opening in said base.

2. Candle support base as defined in claim 1, wherein said at least one opening includes retaining means below said at least one opening, in the orientation of the candle support base during normal use, for at least partially intercepting molten wax flowing through said conduit means and allowing the molten wax to solidify in the region of said at least one opening.

3. Candle support base as defined in claim 1, wherein one opening is provided in said body, and said conduit means comprises a single channel extending between said candle receiving means and said one opening.

4. Candle support base as defined in claim 1, wherein a plurality of openings are provided in said body, and said conduit means comprises a plurality of channels each extending from said candle receiving means and an associated opening, whereby molten wax is initially directed to the lowermost opening and progressively directed to successive openings above said lowermost opening.

5. Candle support base as defined in claim 1, wherein said base includes a surface sculpture, and said at least one opening is formed to blend with the motif of the sculpture.

6. Candle support base as defined in claim 5, wherein said sculpture is in the form of a skull, and said at least one opening comprises the mouth and eye cavities in the skull.

7. Candle support base as defined in claim 1, wherein a trough or channel is provided below said at least one opening for receiving excess wax discharged through said at least one opening.

8. Candle support base as defined in claim 1, wherein said lower end includes a flat surface which can be placed on a flat generally horizontal support surface.

9. Candle support base as defined in claim 8, wherein said upright body generally defines a vertical axis when the base is placed on a horizontal support surface, said candle receiving means being arranged to support a candle along a direction generally parallel to said vertical axis.

10. Candle support base as defined in claim 9, in combination with a candle provided with an eccentric or offset wick to cause one side of the candle to melt more quickly to assure that the majority of the molten wax flows down said candle and into said inlet end of said conduit means.

11. Candle support base as defined in claim 1, wherein said body is formed of non-inflammable material.

12. Candle support base as defined in claim 1, wherein said conduit means is formed of a plurality of channels each for receiving and releasing molten wax.

13. Novelty candle comprising a support base formed of a generally upright body having a lower end configurated to allow the base to be supported and an upper end which includes candle receiving means for receiving the lower end of a candle; at least one opening in said body intermediate said upper and lower ends; conduit means within said upright body having inlet and outlet ends, said inlet end being arranged proximate to said candle receiving means for receiving molten wax which drips off a burning candle supported in said receiving means, and said outlet end being in fluid flow communication with said opening in said body; and a candle provided with an eccentric or offset wick to cause one side of the candle to melt more quickly to assure that the majority of the molten wax flows down said candle and into said inlet end of said conduit means, whereby the burning of the candle causes at least some of molten wax to flow through said conduit means and be discharged through and solidity in the region of said at least one opening in said base.

14. Novelty candle support base as defined in claim 13, wherein said at least one opening includes retaining means below said at least one opening, in the orientation of the candle support base during normal use, for at least partially intercepting molten wax flowing through said conduit means and allowing the molten wax to solidify in the region of said at least one opening.

15. Novelty candle support base as defined in claim 13, wherein one opening is provided in said body, and said conduit means comprises a single channel extending between said candle receiving means and said one opening.

16. Novelty candle support base as defined in claim 13, wherein a plurality of openings are provided in said body, and said conduit means comprises a plurality of channels each extending frown said candle receiving means and an associated opening, whereby molten wax is initially directed to the lowermost opening and progressively directed to successive openings above said lowermost opening.

17. Novelty candle support base as defined in claim 13, wherein said base includes a surface sculpture, and said at least one opening is formed to blend with the motif of the sculpture.

18. Novelty candle support base as defined in claim 17, wherein said sculpture is in the form of a human skull, and said at least one opening comprises the mouth and eye cavities in the skull.

19. Novelty candle support base as defined in claim 13, wherein a trough or channel is provided below said at least one opening for receiving excess wax discharged through said at least one opening.

20. Candle support base comprising a generally upright body having a lower end configurated to allow the base to be supported and an upper end which includes candle receiving means for receiving the lower end of a candle; at least one opening in said body intermediate said upper and lower ends; and conduit means having inlet and outlet ends, said inlet end being arranged proximate to said candle receiving means for receiving molten wax which drips off a burning candle supported in said receiving means, and said outlet end being in fluid flow communication with said opening in said body, whereby the burning of the candle causes at least some of molten wax to flow through said conduit means and be discharged through and solidify in the region of said at least one opening in said base, said at least one opening being arranged on a front side of said body, whereby the wax discharged through said at least one opening can be viewed from one frontal vantage point.

21. Candle support base comprising a generally upright body having a lower end configurated to allow the base to be supported and an upper end which includes candle receiving means for receiving the lower end of a candle; at least one opening in said body intermediate said upper and lower ends; and conduit means having inlet and outlet ends, said inlet end being arranged proximate to said candle receiving means for receiving molten wax which drips off a burning candle supported in said receiving means, and said outlet end being in fluid flow communication with said opening in said body, whereby the burning of the candle causes at least some of molten wax to flow through said conduit means and be discharged through and solidify in the region of said at least one opening in said base, said lower end including a flat surface which can be placed on a flat generally horizontal support surface, and said upright body generally defining an axis offset from the vertical in the direction of said conduit means inlet end to assure that the majority of the molten wax flows into said inlet end of said conduit means.

22. Candle support base comprising a generally upright body having a lower end configurated to allow the base to be supported and an upper end which includes candle receiving means for receiving the lower end of a candle; at least one opening in said body intermediate said upper and lower ends; and conduit means having inlet and outlet ends, said inlet end being arranged proximate to said candle receiving means for receiving molten wax which drips off a burning candle supported in said receiving means, and said outlet end being in fluid flow communication with said opening in said body, whereby the burning of the candle causes at least some of molten wax to flow through said conduit means and be discharged through and solidify in the region of said at least one opening in said base, said conduit means being formed of a plurality of channels each for receiving and releasing molten wax, at least two of said plurality of channels are arranged in series with each other to thereby sequentially receive and release the same molten wax.

23. Candle support base as defined in claim 22, wherein at least two of said plurality of channels are arranged in parallel with each other to thereby each simultaneously receive and release different streams of molten wax.

24. Candle support base as defined in claim 22, wherein at least some of said plurality of channels are arranged in series for receiving and releasing the same streams of molten wax sequentially and at least some of said plurality of channels are arranged in parallel for simultaneously receiving and releasing different streams of molten wax.

* * * * *